US007445429B2

(12) United States Patent
Wilson et al.

(10) Patent No.: US 7,445,429 B2
(45) Date of Patent: Nov. 4, 2008

(54) CROSSOVER TWO-PHASE FLOW PUMP

(75) Inventors: Brown Lyle Wilson, Tulsa, OK (US); Donn J. Brown, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 395 days.

(21) Appl. No.: 11/105,831

(22) Filed: Apr. 14, 2005

(65) Prior Publication Data

US 2006/0245945 A1 Nov. 2, 2006

(51) Int. Cl.
*F04D 29/44* (2006.01)
*E21B 43/00* (2006.01)

(52) U.S. Cl. ..... 415/199.5; 415/187; 415/188; 415/169.1; 415/199.1; 415/199.2; 415/199.3; 415/209.1; 417/405; 417/410.4; 417/423.1; 417/423.3; 166/105.5

(58) Field of Classification Search ..... 415/187, 415/188, 199.5, 209.1, 169.1, 199.1, 199.2, 415/199.3; 417/405, 410.4, 423.1, 423.3; 166/105.5
See application file for complete search history.

(56) References Cited

U.S. PATENT DOCUMENTS 3,143,078 A * 8/1964 Gaslow et al. ..... 417/365
3,291,057 A * 12/1966 Carle ..... 166/105.5
3,438,329 A * 4/1969 Fuller ..... 415/199.3
4,676,308 A * 6/1987 Chow et al. ..... 166/369
6,000,915 A * 12/1999 Hartman ..... 417/356
6,190,141 B1 * 2/2001 Henry ..... 417/423.3
6,705,402 B2 * 3/2004 Proctor ..... 166/369
6,807,802 B2 * 10/2004 Platts ..... 60/39.43
6,896,075 B2 * 5/2005 Haugen et al. ..... 175/57
7,044,718 B1 * 5/2006 Platts ..... 417/405
7,377,313 B2 * 5/2008 Brown et al. ..... 166/105.5
2004/0069501 A1 * 4/2004 Haugen et al. ..... 166/381
2005/0074344 A1 * 4/2005 Gozdawa ..... 417/423.12

OTHER PUBLICATIONS

U.S. Appl. No. 10/784,340, Wilson, et al., filed Feb. 23, 2004.
Gas Separator Fluid Crossover for Well Pump, Brown, et al., filed Apr. 6, 2005.

* cited by examiner

*Primary Examiner*—Devon Kramer
*Assistant Examiner*—Leonard J Weinstein
(74) *Attorney, Agent, or Firm*—Bracewell & Giuliani LLP

(57) ABSTRACT

A hydrocarbon well pump has impellers and diffusers configured with inner and outer sections. The central section contains impeller passages configured for pumping liquid. The outer section contains turbine blades for compressing gas. A cylindrical sidewall separates the two sections. A driven shaft rotates the central and outer sections in unison.

17 Claims, 3 Drawing Sheets

CROSSOVER TWO-PHASE FLOW PUMP

FIELD OF THE INVENTION

This invention relates in general to well pumps and in particular to a pump for pumping a well fluid containing a mixture of liquid and gaseous fluids.

BACKGROUND OF THE INVENTION

A common system for pumping large volumes of fluid from a hydrocarbon well employs an electrical submersible pump assembly. The pump assembly includes a centrifugal pump and a down hole electrical motor. The pump is made up of a large number of pump stages, each pump stage having an impeller and a diffuser. The impeller rotates and imparts velocity to the well fluid while the diffuser converts the kinetic energy to pressure.

Pumps of this type efficiently pump liquids, but many hydrocarbon wells produce both liquid and gas. Efficiently pumping two-phase fluids with a centrifugal pump is difficult if the density difference between the two phases is significant. The impeller stages of a centrifugal pump increase the pressure by imparting velocity to the fluid. The pressure that is created is a function of the density of the fluid. For example, if the liquid components of the well fluid had a density 100 times greater than the gaseous components, the gas would require ten times more velocity to achieve the same pressure as the liquid. Oil has approximately 100 times the density of natural gas at approximately 150 psi. An impeller of a centrifugal pump cannot accomplish the differences in velocity, resulting in the lighter fluid gathering in pockets near the center of rotation. These pockets have great difficulty in moving into the area of high pressure, and therefore grow larger, blocking the flow area and reducing the pressure creation ability of the pump stage until it has been reduced to the point where the gas can move.

One approach to solve the problem of gas content in hydrocarbon well fluid is to utilize a gas separator. The gas separator locates below the pump and separates gas from the liquid, typically by a forced vortex. The forced vortex forces the heavier components to the outer portions of the gas separator housing, leaving the lighter components near the axis of rotation. The heavier components have a much higher velocity than the lighter components. A crossover at the upper end of the gas separator guides the heavier fluid components back into the central area and into the intake of the pump. The lighter fluid components are diverted outward from the gas separator into the casing.

SUMMARY OF THE INVENTION

In this invention, a down hole well pumping apparatus is employed that has a central rotary pump section configured for pumping the liquid or heavier components. An annular turbine section surrounds the pump section. The turbine section has blades for compressing the gaseous components.

A cylindrical wall separates the pump section from the turbine section. The rotatable components of the pump section and the turbine section preferably rotate in unison. The pump thus increases the pressure of both the heavier and the lighter components.

DETAILED DESCRIPTION OF THE PREFERRED EMBODIMENT

Figure 9:
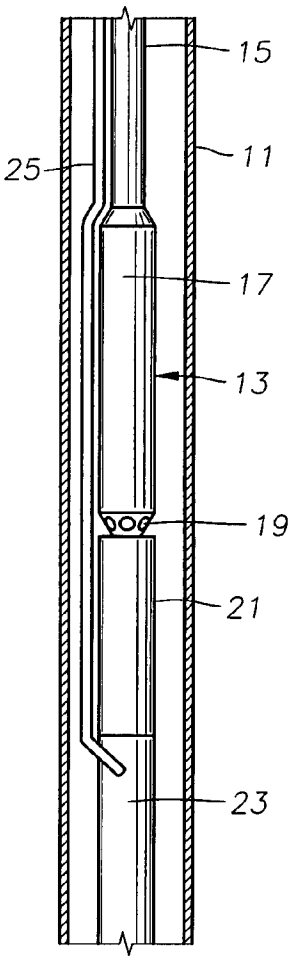
FIG. 9 is a schematic elevational view of the pump of FIG. 1 incorporated within a pump assembly in a well.

Referring first to FIG. 9, a well has a casing 11 containing perforations (not shown) for admitting formation fluid. An electrical submersible pump assembly 13 is suspended in casing 11 on a string of tubing 15. Tubing 15 may comprise sections of production tubing secured together. Alternately, tubing 15 may comprise a continuous string of coiled tubing. Well fluid pumped by ESP assembly 13 flows up tubing 15, but it could alternately be configured to flow up the annulus surrounding tubing 15 within casing 11.

Pump 17 is secured to tubing 15 and has an intake 19 for drawing in well fluid. A seal section 21 connects the lower end of pump 17 to motor 23. Seal section 21 reduces the pressure differential between the lubricant in motor 23 and the hydrostatic pressure of the well fluid in casing 11. A power cable 25 extends from the surface to motor 23 for supplying electrical power.

Figure 1A:
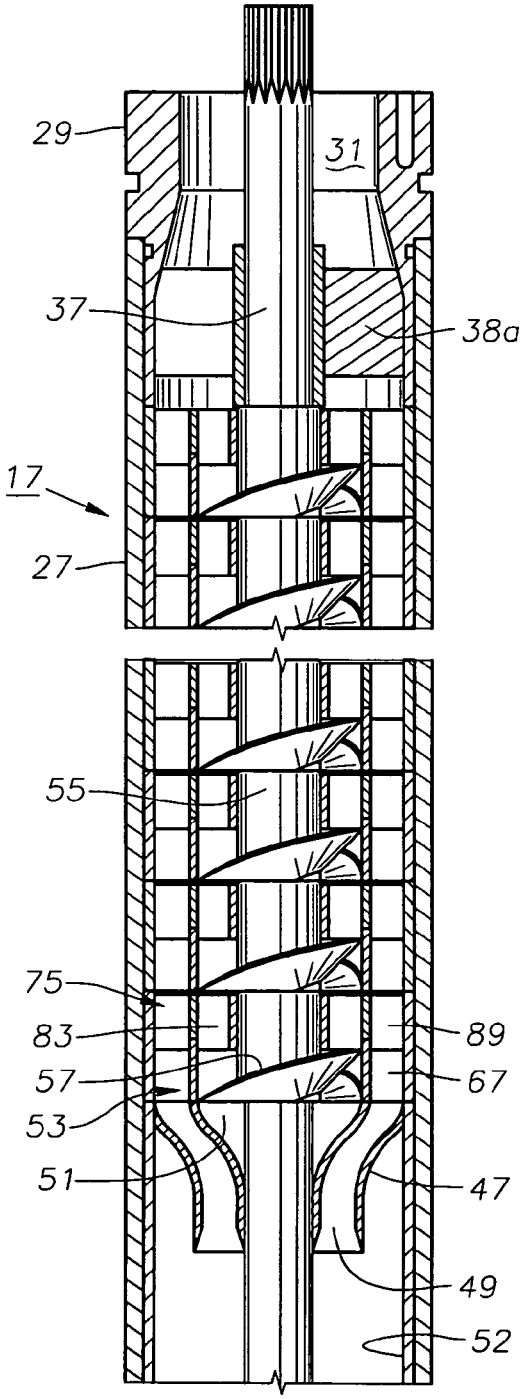
FIGS. 1A and 1B comprise a vertical sectional view of a pump assembly constructed in accordance with this invention.
Figure 1B:
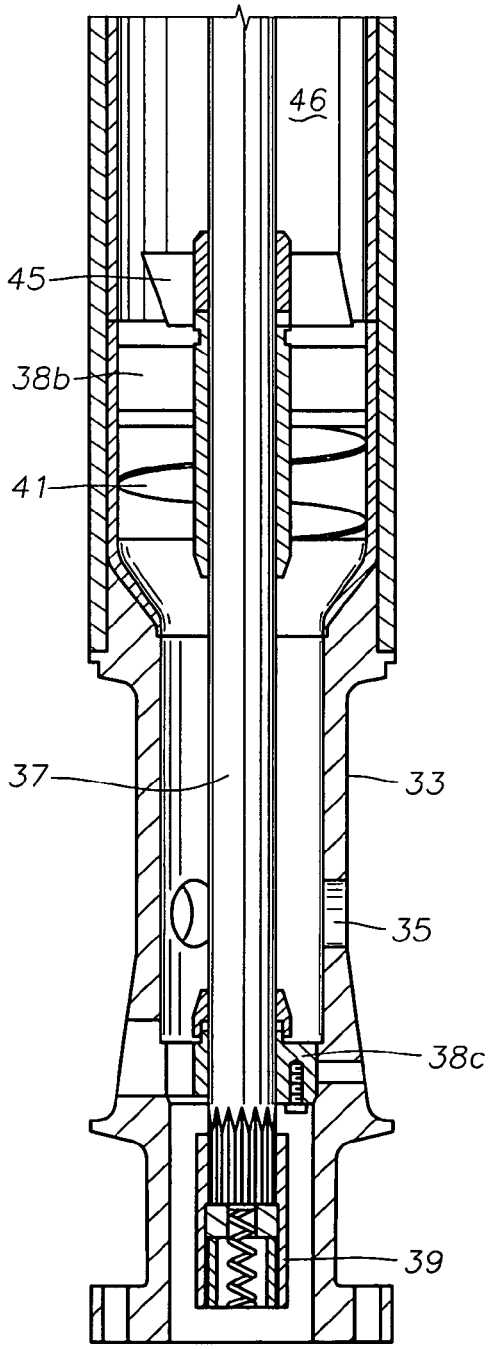

Referring to FIGS. 1A and 1B, pump 17 has a tubular housing 27. Housing 27 includes a discharge adapter 29 at its upper end. The particular adapter 29 shown is a type that would be used to connect pump 17 to another pump (not shown) in tandem. Adapter 29 could alternately be configured for connection to tubing 15 (FIG. 1). Discharge adapter 29 has a discharge passage 31. As shown in FIG. 1B, housing 27 also includes an intake adapter 33 on its lower end. Intake adapter 33 has intake ports 35 and connects to seal section 21 (FIG. 9).

A shaft 37 extends through housing 27. Shaft 37 is supported by bearings 38*a*, 38*b*, and 38*c*. Shaft 37 is shown having a splined upper end, which would be used in case pump 17 is connected in tandem to another pump. Alternately, the upper end of shaft could terminate without a splined end, in which case an adapter for connecting pump 17 to tubing 15 would be employed. A coupling 39 on the lower end of shaft 37 connects shaft 37 to a shaft of seal section 21, which in turn is rotated by the shaft of motor 23 (FIG. 9).

In this embodiment, an inducer 41 is located at the lower end of pump 17 above intake ports 35. Inducer 41 is optional and in this embodiment comprises a helical vane that rotates with shaft 37, serving as an auger. A gas/liquid separator is located above inducer 41. The separator could be of a variety of types and preferably is a forced vortex type that uses centrifugal force to cause a separation of the lighter and heavier components of the well fluid. Alternately, a passive device of a type that creates a swirling motion of the upward flowing well fluid might be suitable in some cases. The gas separator shown includes a set of blades or vanes 45 that rotate with shaft 37 to impart centrifugal force to the well fluid. Vanes 45 cause heavier and lighter components of the well fluid to separate. The heavier components flow to the outer annular area while the lighter components remain in a central area near shaft 37. Preferably, an annular separation chamber 46 extends above rotor vanes 45 to provide room for the separation to occur. In this example, separation chamber 46 is passive and free of any structure other than shaft 37. Alternately, rather than an empty chamber 46, rotor vanes 45 could be located within an upward extending cylinder that also rotates.

A crossover member 47 at the upper end of chamber 46 has a central inlet 49 in an annular space surrounding shaft 37. The lighter components, mostly gaseous fluids, flow into passage 49, which directs them upward and radially outward. The annular space on the exterior of central inlet 49 leads upward and inward to a central outlet 51 that is in a central area surrounding shaft 37. The heavier components, mostly liquid, flow from the outer annular area of separation chamber 46 into the central outlet 51. In this embodiment, chamber 46 has a stationary cylindrical liner 52 that extends within housing 27 from intake adapter 33 to the upper end of crossover member 47. Liner 52 may be of a more corrosion resistant material than housing 27 for protecting the interior of housing 27.

Figure 2:
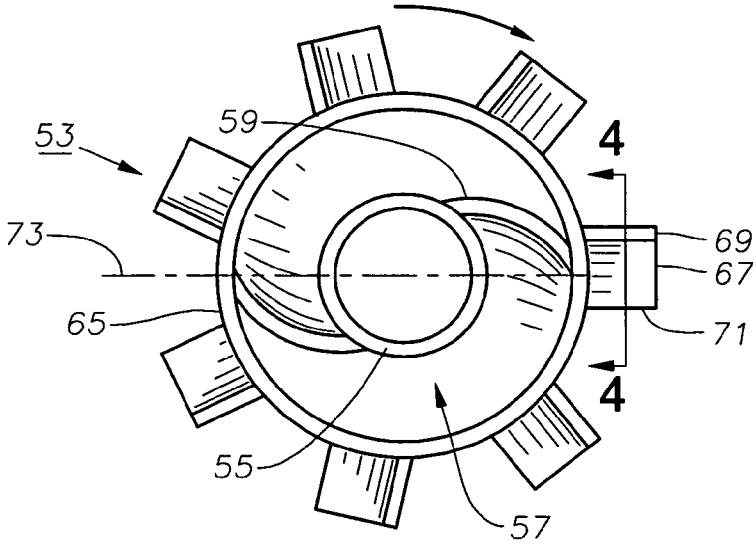
FIG. 2 is a top view of one of the impellers of the pump assembly of FIG. 1.

A number of pump stages are located in housing 27 between crossover member 47 and upper bearing 38*a*. Referring to FIG. 2, each pump stage has an impeller 53 that rotates in unison with shaft 37 (FIG. 1A). Impeller 53 has a cylindrical hub 55 that slides over and is connected to shaft 37 (FIG. 1A) by a key. Impeller 53 has a central section that registers with crossover outlet 51 (FIG. 1A) for receiving heavier well fluid components. The central section of each impeller 53 has at least one helical passage defined by at least one blade or vane configured for pumping primarily liquid. In the preferred embodiment, the passage is defined by at least one helical flight 57. In this example, two helical flights 57 are employed. Each helical flight 57 extends around hub 55 a circumferential distance of about 180 degrees from a lower edge of helical flight 57 to an upper edge 59 of helical flight 57. Preferably each flight 57 extends at least 90 degrees, and if flights 57 extended only 90 degrees, preferably four flights 57 would be employed. Helical passages for fluid flow are defined by the upper and lower surfaces of each flight 57. Upper edge 59 of each helical flight 57 lags the inner edge considering the direction of rotation.

Figure 5:
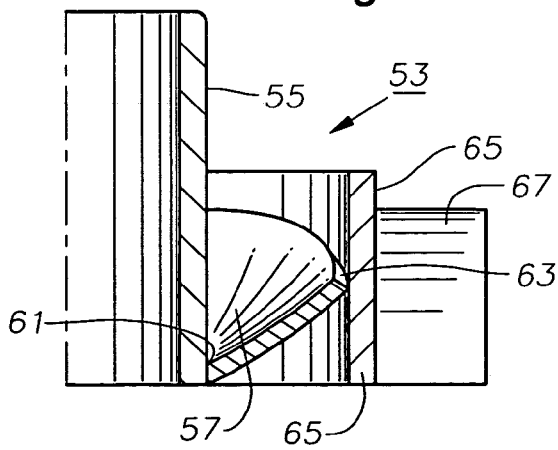
FIG. 5 is a quarter sectional view of a portion of the impeller of FIG. 2.

Also, as shown in FIG. 5, optionally each helical flight 57 is conical in cross-section from an inner edge 61 to an outer edge 63. Outer edge 63 is located axially downstream of inner edge 61 as measured along a radial line extending from the longitudinal axis. Inner edge 61 joins hub 55 and outer edge 63 joins a cylindrical sidewall 65.

Figure 4:
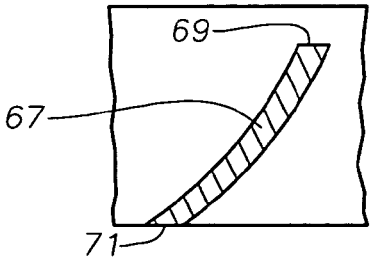
FIG. 4 is a sectional view of one of the turbine blades of the impeller of FIG. 2, taken along the line 4-4 of FIG. 2.

Referring again to FIG. 2, each impeller 53 has an outer section that surrounds sidewall 65. The outer section has a plurality of blades, vanes or passages configured primarily for compressing gas. In the preferred embodiment, the outer section comprises a plurality of turbine blades 67 mounted to sidewall 65 and protruding outward therefrom. Each turbine blade 67 is configured for pumping a fluid having significant gas content, thus turbine blades 67 may be considered to be gas compressor blades. Each turbine blade 67 has an upper edge 69 and a lower edge 71. Lower edge 71 leads considering the direction of rotation as indicated by the arrow in FIG. 2. Upper edge 69 and lower edge 71 are preferably parallel to each other. Also, upper edge 69 and lower edge 71 are preferably offset and parallel to a radial line 73. Turbine blades 67 are preferably concave as illustrated in FIG. 4.

Preferably, there are more blades 67 than helical flights 57. In this embodiment, seven turbine blades 67 are illustrated, but the number could vary. Turbine blades 67 rotate in unison with helical flights 57, but at a faster rotational velocity because of the farther distance from the centerline of impeller 53.

Figure 3:
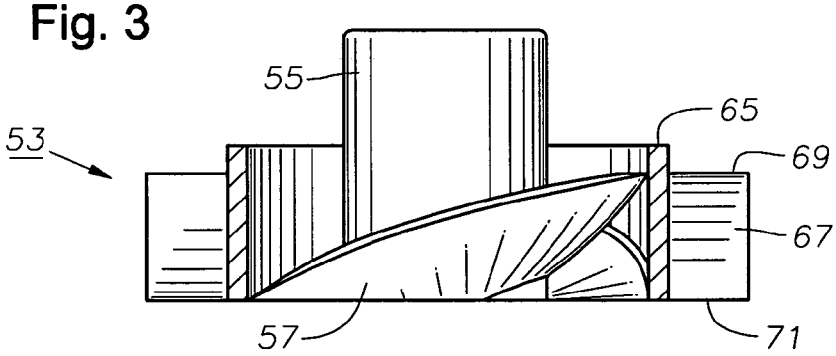
FIG. 3 is a side view of the impeller of FIG. 2, with portions sectioned to illustrate the impeller auger flights.
Figure 7:
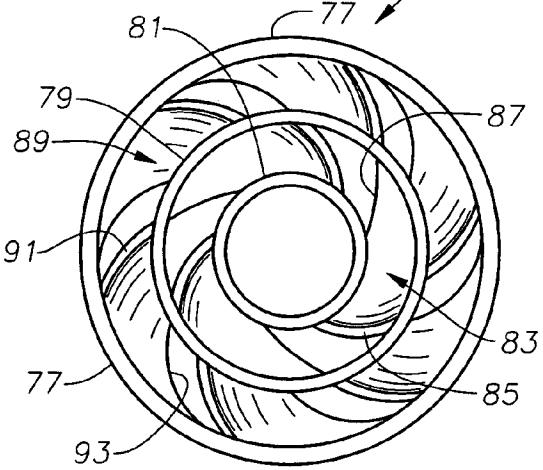
FIG. 7 is a top view of the diffuser of FIG. 6.
Figure 6:
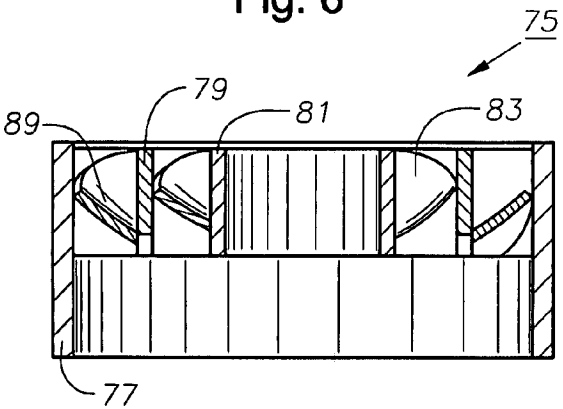
FIG. 6 is a sectional view of a diffuser of the pump of FIGS. 1A and 1B.
Figure 8:
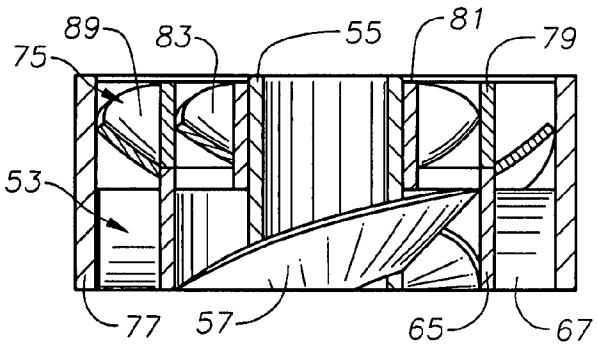
FIG. 8 is a vertical sectional view of the impeller of FIG. 2 assembled with the diffuser of FIG. 6.

Referring to FIGS. 6 and 7, each pump stage has a diffuser 75 that mates with one of the impellers 53 (FIG. 2). Diffuser 75 is stationary and has an outer wall 77 with a depending portion for receiving a mating impeller 53 within its interior, as illustrated in FIG. 8. Outer wall 77 contacts and transmits downward thrust to liner 52 (FIG. 1A), which in turn directs thrust to the lower end of housing 27. Diffuser 75 has an inner wall 79 that is cylindrical and the same diameter as sidewall 65 (FIG. 3) of impeller 53. A hub or sleeve 81 locates within the center of each diffuser 75. An upper extending portion of impeller hub 55 (FIG. 3) extends into sliding engagement with the inner diameter of sleeve 81.

A plurality of stationary helical blades 83 extend between sleeve 81 and inner side wall 79 as illustrated in FIG. 7. Helical blades 83 extend in the opposite direction from helical flights 57 of impeller 53 (FIG. 2). Helical blades 83 define diffuser passages between them for directing fluid upward and radially inward to the next impeller 53 (FIG. 2). While doing so, the diffuser passages defined by blades 83 slow the velocity of the fluid and convert kinetic energy into higher pressure. There are three diffuser blades 83 in this example, and each extends less than 120 degrees. In this embodiment, each diffuser blade 83 extends circumferentially about 70 degrees from a lower edge 87 to an upper edge 85, but that could vary.

A plurality of stationary outer blades 89 extend from inner wall 79 to outer wall 77. In this embodiment, there are six outer blades 89, but that number could vary. Each diffuser blade 89 has an upper edge 91 and a lower edge 93. Preferably each outer blade 89 is concave and inclines in the opposite direction to turbine blades 67 (FIG. 2). Lower edge 93 is upstream from upper edge 91. Outer blades 89 extend helically to define passages between them to convert kinetic energy of the gaseous fluids into pressure. In this example, each outer blade 89 extends about 45 degrees measured at the inner edge where it joins inner wall 79. Other configurations are available.

In operation, ESP assembly 13 is installed in a well. Electrical power is supplied over cable 25 to motor 23 to rotate motor 23 at a conventional speed such as 3600 rpm. Alternately, the speed could be varied by a variable speed drive, but rotation greater than 3600 rpm is not required. Referring to FIGS. 1A and 1B, shaft 37 rotates inducer 41 to draw well fluid in through intake ports 35. Vanes 45 rotate with shaft 37, creating a forced vortex with heavier components flowing outward near liner 52 and lighter components remaining near shaft 37. Crossover member 47 reverses the positions of the lighter and heavier components of the well fluid stream. The gaseous fluid flows up passage 49 into the outer section of the first impeller 53. The heavier components flow into the central section of the first impeller 53.

Impellers 53 rotate in unison with shaft 37 while diffusers 75 remain stationary. The central pump section of each impeller 53 increases the velocity of the heavier components with helical flights 57. Turbine blades 67 of impellers 53 increase the velocity of the lighter components. Each diffuser 75 slows the velocities with inner blades 83 and outer blades 89. The reduction in velocity increases the pressures of the heavier and lighter components and delivers the separate streams to the next downstream impeller 53.

The dynamic pressure of the heavier components at each stage likely will differ from the dynamic pressure of the gaseous components at the same stage, but the sidewalls 65 and 79 prevent commingling of the gas and liquid components. The pressure increases with each pump stage. The well fluid stream exits the uppermost pump stage with the lighter components still located outward from the heavier components. These components could both flow into common discharge 31 and from there through tubing 15 (FIG. 9) to the surface. If so, the fluids would be free to commingle within common discharge 31 and tubing 15. Alternately, the separated gas could be directed out of housing 27 into the casing annulus surrounding tubing 15 or to a separate conduit extending to the surface.

The invention has significant advantages. The separate inner and outer sections of the impellers and diffusers are configured for pumping liquid and gaseous fluids, respectively. Because the outer section is configured for compressing gas, gas pockets do not develop in the central section, which otherwise tend to block the pumping of liquids. Because the outer section rotates faster than the central section, the outer section vanes and diffuser blades are able to efficiently compress the gas. The helical flight or flights are able to efficiently pump the liquid even though the rotational speed is slower in the inner section. If desired, both the heavier and lighter liquids can be conveyed up the tubing from the pump. The sidewalls between the central and outer sections of the impellers and diffusers prevent commingling within the pump.

While the invention has been shown in only one of its forms, it should be apparent to those skilled in the art that it is not so limited but is susceptible to various changes without departing from the scope of the invention. For example, a continuous helical flight could be utilized in the central section, rather than separating the impeller helical flight sections by stationary diffuser blades. Further, rather than helical flights in the central section of the impeller, the central portion could have spiral passages similar to impellers of conventional centrifugal pumps. Also, rather than incorporating the gas separator into the housing of the pump, a conventional gas separator could be attached below the pump.

We claim:

1. An apparatus for pumping a well fluid containing gaseous and liquid components, comprising:

a central rotary pump section for pumping the liquid components;

an annular turbine section having a plurality of turbine stages surrounding the central rotary pump section for compressing the gaseous components, each of the turbine stages comprising a plurality of rotatable turbine blades and a turbine diffuser, the turbine blades being rotatable relative to the turbine diffuser;

wherein the central rotary pump section comprises a plurality of pump stages, each pump stage comprising an impeller and a pump diffuser, the impeller of each pump stage being rotatable relative to the pump diffuser of each pump stage;

a housing containing the turbine section and the central rotary pump section;

a separating device in the housing upstream of the turbine section and the central rotary pump section for separating well fluid flowing into the housing into an outer portion and an inner portion, the outer portion containing more liquid components than the inner portion, and the inner portion containing more gaseous components than outer portion; and a cross-over device downstream of the separating device and upstream of the turbine section and the central rotary pump section for guiding the outer portion of the well fluid into the central rotary pump section and guiding the inner portion of the well fluid into the annular turbine section.

2. The apparatus according to claim 1, further comprising:

a cylindrical wall separating the central rotary pump section from the annular turbine section.

3. The apparatus according to claim 1, wherein the impellers of the central rotary pump section rotate in unison with the turbine blades of the annular turbine section.

4. The apparatus according to claim 1, wherein each of the turbine diffusers comprises a set of stationary diffuser blades.

5. The apparatus according to claim 1, wherein each impeller has a rotating passage that extends helically in a first rotational direction, and each pump diffuser has a plurality of stationary passages that extend helically in a second direction, the rotating passage of each pump stage being rotatable relative to the stationary passages of each pump diffuser.

6. The apparatus according to claim 1, wherein:

each of the impellers has at least one rotating blade;

the turbine blades rotate in unison with the rotating blades of the impellers; and there are more of the turbine blades in each stage of the annular turbine section than the rotating blades in each stage of the central rotary pump section.

7. An apparatus for pumping a well fluid containing gaseous and liquid components, comprising:

a housing having a longitudinal axis;

a rotatably driven shaft extending through the housing;

a plurality of impellers mounted to the shaft for rotation therewith, each of the impellers having a central section for receiving liquid components of the well fluid from the central portion of the housing and an outer section portion for receiving gaseous components of the well fluid;

a cylindrical wall in each impeller separating the central section from the outer section;

the central section of each impeller containing at least one helically extending impeller passage configured for pumping substantially liquid;

the outer section of each impeller containing a plurality of blades configured for compressing gas; and a diffuser mating with each impeller, each of the diffusers being mounted in the housing, each of the diffusers having a central section that registers with the central section of one of the impellers and an outer section that registers with the outer section of one of the impellers;

an inner cylindrical wall in each of the diffusers that separates its central section from its outer section;

an outer cylindrical wall surrounding the outer section of each of the diffusers, the outer cylindrical walls of the diffusers engaging the housing and being stacked together to prevent rotation of the diffusers; and the outer section of the diffuser having a plurality of diffuser passages configured to convert kinetic energy of the gaseous components flowing from the outer section of its mated impeller into a greater pressure.

8. The apparatus according to claim 7, further comprising:

a plurality of diffuser passages in the central section of each of the diffusers configured to convert kinetic energy of the liquid components flowing from the central section of its mated impeller into a greater pressure.

9. The apparatus according to claim 7, wherein an auger flight defines the impeller passage of the central section of each of the impellers.

10. The apparatus according to claim 7, wherein the blades of the outer section of the impeller comprise turbine blades, and wherein each impeller has more turbine blades than impeller passages in its central section.

11. The apparatus according to claim 7, wherein the central section of each impeller comprises a hub that receives the shaft; and wherein the helical passage is defined by a helical flight extending between the hub and the cylindrical wall of the impeller, the helical flight extending at least 90 degrees circumferentially around the hub.

12. The apparatus according to claim 7 further comprising:

a separating device for causing liquid components of the well fluid to flow up an outer portion of the housing and gaseous components of the well fluid to flow up a central portion of the housing; and a cross-over device downstream of the separating device and upstream of the impellers and diffusers for guiding the liquid components of the well fluid from the outer portion of the housing into the central portion of the housing and guiding the gaseous components of the well fluid from the central portion to the outer portion of the housing.

13. The apparatus according to claim 12, wherein the separating device comprises a plurality of vanes that rotate with the shaft.

14. The apparatus according to claim 7, wherein the housing has a single outlet for receiving and commingling the liquid and gaseous components discharged from the diffusers and the impellers.

15. A method for pumping a well fluid from a well containing gaseous and liquid components, comprising:

(a) mounting an annular turbine section around a central rotary pump section;

(b) deploying the annular turbine section and the central rotary pump section in the well and rotating the annular turbine section and the central rotary pump section;

(c) causing a stream of well fluid containing a mixture of liquid and gas components to flow toward the annular turbine section and the central rotary pump section and prior to reaching the annular turbine section and the central rotary pump section, separating the stream into an outer portion and an inner portion, the outer portion containing more liquid components than the inner portion, and the inner portion containing more gaseous components than the outer portion;

(d) delivering the outer portion of the flow stream to the central rotary pump section and pumping the outer portion of the flow streams with the central rotary pump section; and (e) delivering the inner portion of the flow stream to the annular turbine section and compressing the gaseous components within the inner portion of the flow stream with the annular turbine section.

16. The method according to claim 15, wherein step (b) comprises rotating the annular turbine section and the central rotary pump section in unison.

17. The method according to claim 15, further comprising after step (e) commingling the liquid components and the gaseous components and delivering the commingled gas and liquid components up the well to the surface.

* * * * *